US010745255B2

(12) United States Patent
Kranz et al.

(10) Patent No.: US 10,745,255 B2
(45) Date of Patent: Aug. 18, 2020

(54) VEHICLE BOOM ARM ALARM SYSTEM

(71) Applicant: STEMCO PRODUCTS, INC., Charlotte, NC (US)

(72) Inventors: Mark J. Kranz, Longview, TX (US); Michael J. Massey, Longview, TX (US)

(73) Assignee: Stemco Products, Inc., Charlotte, NC (US)

( * ) Notice: Subject to any disclaimer, the term of this patent is extended or adjusted under 35 U.S.C. 154(b) by 0 days.

(21) Appl. No.: 16/216,708

(22) Filed: Dec. 11, 2018

(65) Prior Publication Data

US 2019/0202672 A1 Jul. 4, 2019

Related U.S. Application Data

(60) Provisional application No. 62/611,800, filed on Dec. 29, 2017.

(51) Int. Cl.

| | |
|---|---|
| ***B66C 23/88*** | (2006.01) |
| ***B66C 13/44*** | (2006.01) |
| ***E02F 9/20*** | (2006.01) |
| ***E02F 9/26*** | (2006.01) |

(52) U.S. Cl.

CPC ..... *B66C 23/88* (2013.01); *B66C 13/44* (2013.01); *E02F 9/2033* (2013.01); *E02F 9/264* (2013.01); *E02F 9/267* (2013.01)

(58) Field of Classification Search

CPC ..... B66C 23/88; B66C 23/701; B66F 11/04; E02F 9/267

USPC ..... 340/686.1

See application file for complete search history.

(56) References Cited

U.S. PATENT DOCUMENTS

| | | | | |
|---|---|---|---|---|
| 4,863,337 | A * | 9/1989 | Ishiguro | E02F 3/432 414/699 |
| 5,957,989 | A * | 9/1999 | Egawa | E02F 9/2033 701/50 |
| 7,772,969 | B2 * | 8/2010 | Prohaska | B62D 33/0633 180/326 |
| 2018/0155165 | A1 * | 6/2018 | Vossen | F16F 9/067 |

FOREIGN PATENT DOCUMENTS

| | | | |
|---|---|---|---|
| EP | 2558403 | A1 | 2/2013 |
| RU | 143808 | U1 | 7/2014 |
| WO | WO 2010/1282460 | | 11/2010 |
| WO | WO 2011/128510 | A1 | 10/2011 |

OTHER PUBLICATIONS

International Search Report and Written Opinion for PCT/US2018/065106 dated Mar. 21, 2019.

* cited by examiner

*Primary Examiner* — Qutbuddin Ghulamali

(74) *Attorney, Agent, or Firm* — Perkkins Coie LLP

(57) ABSTRACT

A boom arm sensor assembly is provided. The boom arm sensor assembly includes a proximity sensor. The proximity sensor detects whether a boom arm for a trailer is positioned within a saddle on the trailer. The boom arm sensor assembly also includes a transmitter that transmits a signal at least when the boom arm is not detected in the saddle to a boom arm alarm assembly, which also is provided. The boom arm alarm assembly provides an alarm to a vehicle driver that the boom arm is not positioned within the saddle.

21 Claims, 7 Drawing Sheets

VEHICLE BOOM ARM ALARM SYSTEM

CROSS-REFERENCE TO RELATED PATENT APPLICATIONS

This application claims priority to U.S. Provisional Patent Application Ser. No. 62/611,800, filed on Dec. 29, 2017, the entire contents of which is incorporated herein by reference and relied upon.

BACKGROUND

Vehicles, in some instances, have boom arms. A boom arm is a member that cantilevers from a body of the vehicle. Typically boom arms are associated with industrial vehicles, such as rail cars, fuel delivery vehicles, feed trailers, and the like. While the technology of the present application will be described with respect to industrial vehicles, with specific reference to feed trailers, the vehicle to which a boom arm may be attached should not be limited to industrial vehicles and/or feed trailers.

With reference to FIG. 1, a conventional feed trailer 10 is shown having a boom arm 12. The feed trailer 10 is coupled to a cab 14, which feed trailer 10 and cab 14 coupled together may be referred to as a truck or heavy-duty truck. As can be appreciated, the boom arm 12 as shown has a length L that is approximately equal to the length of the feed trailer. The boom arm 12 may have a length shorter or longer than the feed trailer in certain instances. The boom arm 12 is a single long member as shown. More complicated boom arms may provide multiple arms 12 coupled by a pivot point (not shown here), such as by joining the multiple arms 12 with knuckles or the like. The boom arm 12 is coupled to a rear end 16 of the feed trailer 10 at a pivot 18, such as by using the aforementioned knuckle or the like. The length of the boom arm 12 is supported, in the stowed position 20, by one or more saddles 22 extending from the freed trailer 10. The boom arm 12 may be restricted from movement when in the stowed position 20 by a latch, tie, lock, or the like, not shown in the figures, but generally known in the art.

While not shown, the boom arm 12 is pivoted about the pivot 18 such that the boom arm 12 is deployed away from the feed trailer 10 during use, which may be described as the deployed position. Typically, the feed trailer 10 is stationary when the boom arm 12 is deployed. If the feed trailer 10 is coupled to the cab 14, forming the aforementioned truck, often the truck has a parking brake set to inhibit movement of the cab 14 and feed trailer 10 during operation of the boom arm 12.

After use, the boom arm 12 needs to be returned into the stowed position 20 by pivoting the boom arm 12 back into the saddle or saddles 22 prior to the feed truck 10 being moved. The boom arm 12, the feed trailer 10, the truck 14 and potentially the associated property, are all subject to damage if the feed truck 10 is moved while the boom arm 12 is not in the stowed position 20. Unfortunately, operators of the truck 14 fail to confirm the boom arm 12 is in a stowed condition in some circumstances.

While some boom arms 12 have alarms to alert drivers that the boom arm 12 is not properly stowed in the saddle (or saddles) 22, conventional alarm systems employ complex wiring harnesses or manual configurations and are frequently easy to by-pass or disengage. Thus, conventional alarm systems are inadequate to present day operating conditions. Thus, against this background, an improved vehicle boom arm alarm is required.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

The technology of the present application will now be described more fully below with reference to the accompanying figures, which form a part hereof and show, by way of illustration, specific exemplary embodiments. These embodiments are disclosed in sufficient detail to enable those skilled in the art to practice the technology of the present application. However, embodiments may be implemented in many different forms and should not be construed as being limited to the embodiments set forth herein. The following detailed description is, therefore, not to be taken in a limiting sense.

The technology of the present application is described with specific reference to boom arms mounted on feed trailers. However, the technology described herein may be used for other vehicle having a cantilevered member pivotally coupled to the vehicle, and the like. For example, the technology of the present application may be applicable to fuel or refueling vehicles, vehicle cranes, or the like. Moreover, the technology of the present application will be described with relation to exemplary embodiments. The word "exemplary" is used herein to mean "serving as an example, instance, or illustration." Any embodiment described herein as "exemplary" is not necessarily to be construed as preferred or advantageous over other embodiments. Additionally, unless specifically identified otherwise, all embodiments described herein should be considered exemplary.

Figure 1:
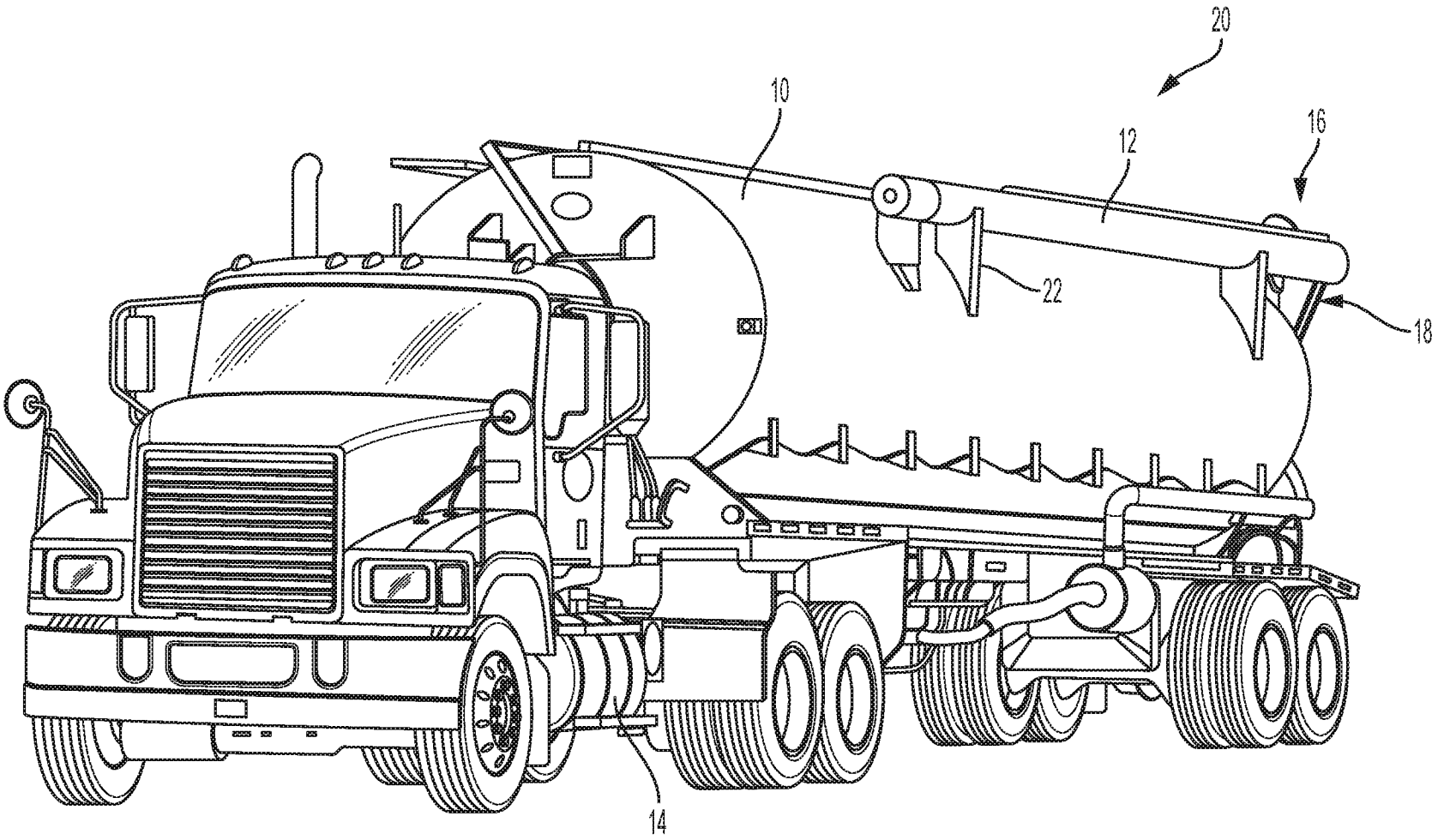
FIG. 1 (Prior Art)
FIG. 1 is a perspective view of a conventional feed trailer and truck with a boom arm.
Figure 2:
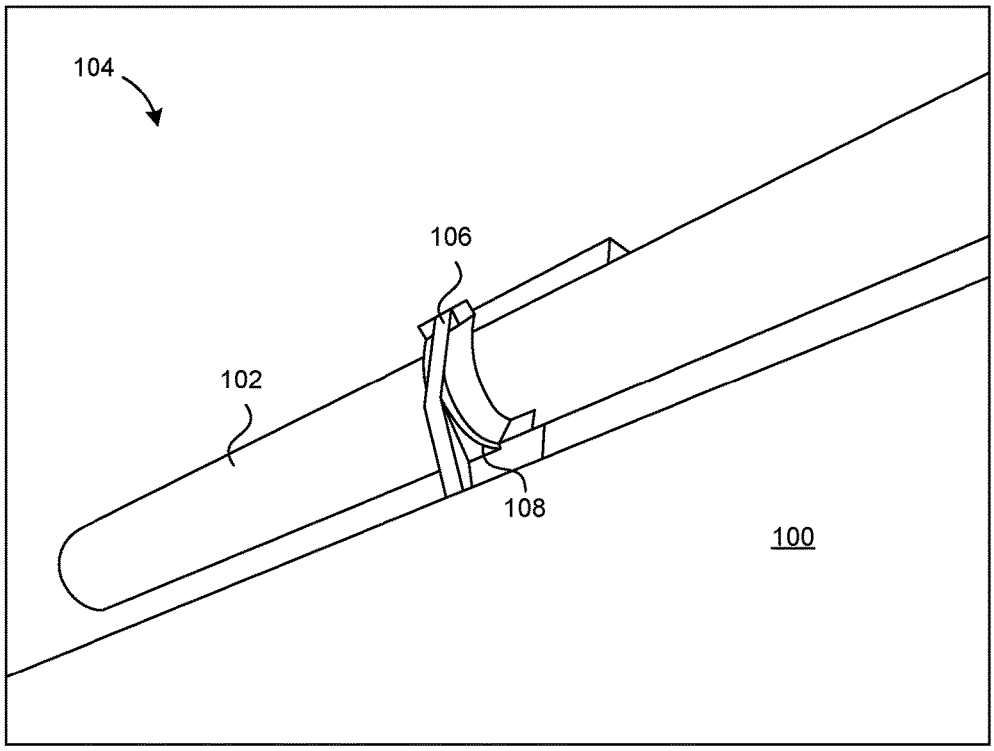
FIG. 2 is a view of a boom arm on a feed trailer consistent with the technology of the present application.
Figure 3:
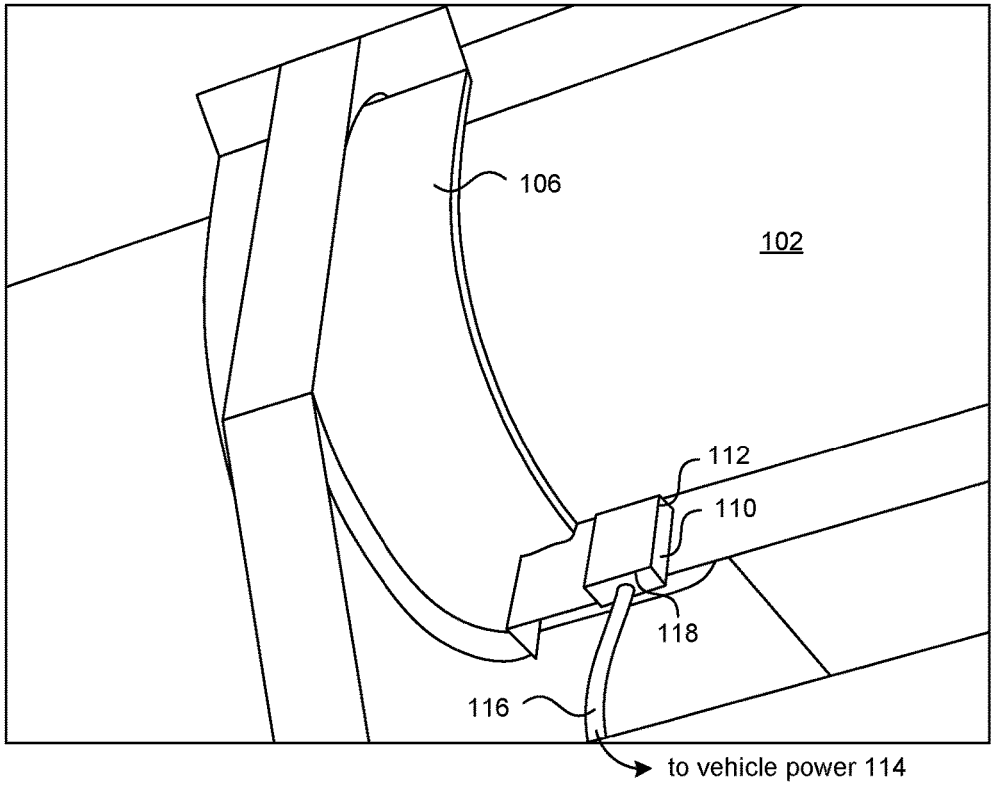
FIG. 3 is a detail of the boom arm and saddle of FIG. 2.
Figure 4:
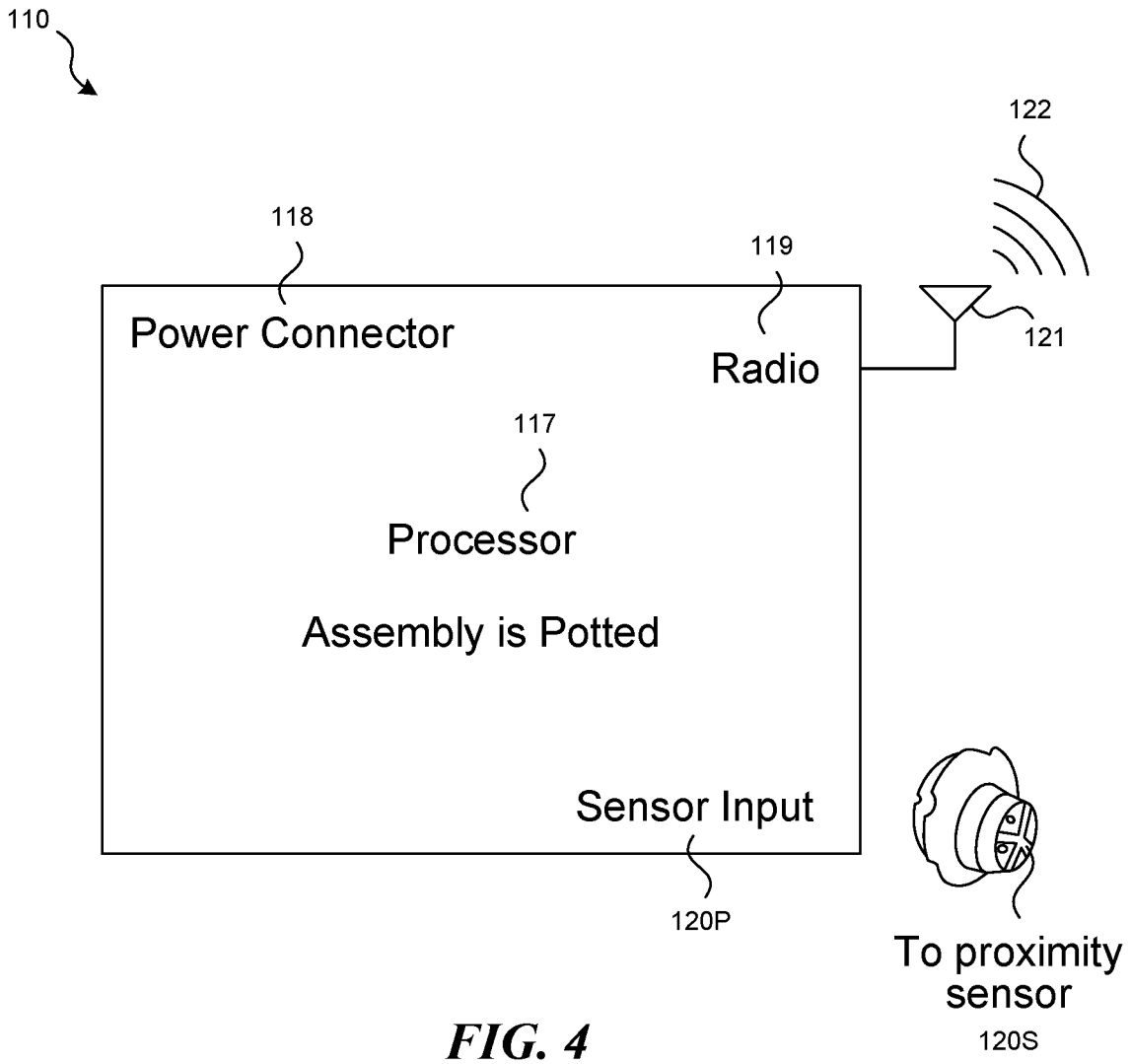
FIG. 4 is a diagram of a sensor assembly consistent with the technology of the present application.

With reference now to FIGS. 2 and 3, a feed trailer 100 with a boom arm 102 is shown that is consistent with the technology of the present application. The boom arm 102 is shown in a stowed position 104 with the boom arm 102 stowed in one or more saddles 106. The saddles 106 may take a number of forms, but are shown here as a U shaped bracket 108 coupled to the feed trailer 100. FIG. 3 provides a detail of the saddle 106 holding a portion of the boom arm 102 and the mounting of a sensor assembly 110. The sensor assembly 110 includes a housing 112. Power may be supplied from vehicle power 114 through a cable 116 into a power port 118 on the housing 112 of the sensor assembly 110. With reference to FIG. 4, the sensor assembly 110 is shown in more detail. The sensor assembly 110, as shown within the housing 112, includes the power port 118 that is configured to couple to a cable 116 to provide power from the vehicle power 114, a processor 117, a transmitter 119 (which may be a radio, a transceiver, or a separate transmitter) with an antenna 121, and a proximity sensor 120S (or a port 120P to receive a signal from a proximity sensor 120S). As shown in FIG. 4, the sensor assembly 110 includes a port 120P to receive a signal from the proximity sensor 120*s*, which may be mounted on the saddle 106.

The proximity sensor 120S is designed to provide a signal to the processor 117 regarding the status of the boom arm 102 being seated or stowed in the saddle 106. Because the boom arm 102 may be maintained in the saddle 106 by gravity as opposed to a latch or the like, the proximity sensor 120S is designed to detect the boom arm 102 when it is within a predefined distance D to the proximity sensor 120S, which distance would be determined as sufficiently within the saddle 106 to be considered stowed. Typically, the boom arm 102 is formed, at least in part, by a ferrous material, such as steel, iron, etc., Thus, the proximity senor 120S may comprise an inductive sensor, a metal detector, but could be other sensors such as a magnetic sensor, a reed switch, a hall effect sensor, a magnetometer, or the like that can detect the presence of the boom arm 102 within a range of 0 millimeters to about 18 millimeters but as far as 30 millimeters is possible in some embodiments. If the boom arm 102 is not within the detectable range of the proximity sensor 120S, the processor 117 would interpret the signal that the boom arm 102 is not within the saddle 106 and/or not in the stowed position. The proximity sensor 120S may send a digital or analog signal where a high value is considered stowed or a low value is considered stowed as a matter of design choice. The actual range of the magnetic sensor could be adjusted to avoid providing a false positive that the boom arm 102 is within the saddle 106. Thus, the range of the proximity sensor 120S may depend on the specific configuration of the saddle 106 and boom arm 102. However, as mentioned, a range of approximately 0-18 millimeters is typically sufficient although for larger saddles, a range of up to about 30 millimeters may be desirous.

While the proximity sensor 120S is described above as a magnetic sensor to detect the presence, within a certain distance, of the boom arm 102, which is typically made from a ferrous material, the proximity sensor 120S may take other forms. In cases where the boom is constructed from a nonferrous metal, such as with aluminum, the sensor 120S may be an inductive sensor, or the like, that can detect nonferrous materials. Of course, other detectors are possible in different embodiments. For example, the proximity sensor 120S may be a pressure switch mounted that detects the increase in load on the saddle 106 when the boom arm 102 is in the stowed position. In certain configurations, the proximity sensor 120S may be a mechanical switch, such as a push button, that switches when the boom arm 102 is pressed into the switch. Other proximity sensors 120S as are generally known in the art are possible as well.

The processor 117, which has controls the functions of the sensor assembly, causes the transmitter 119 to broadcast a signal 122 via the antenna 121. The signal 122 will be broadcast to a receiver in the truck cab, which will be explained further below. The signal 122 would include data regarding whether the proximity sensor 120S detected the boom arm 102 to be stowed or not. The data may include, as will be explained further below, the power on time of the processor 117 as well as the serial number of the processor 117 or housing assembly 110.

Figure 5:
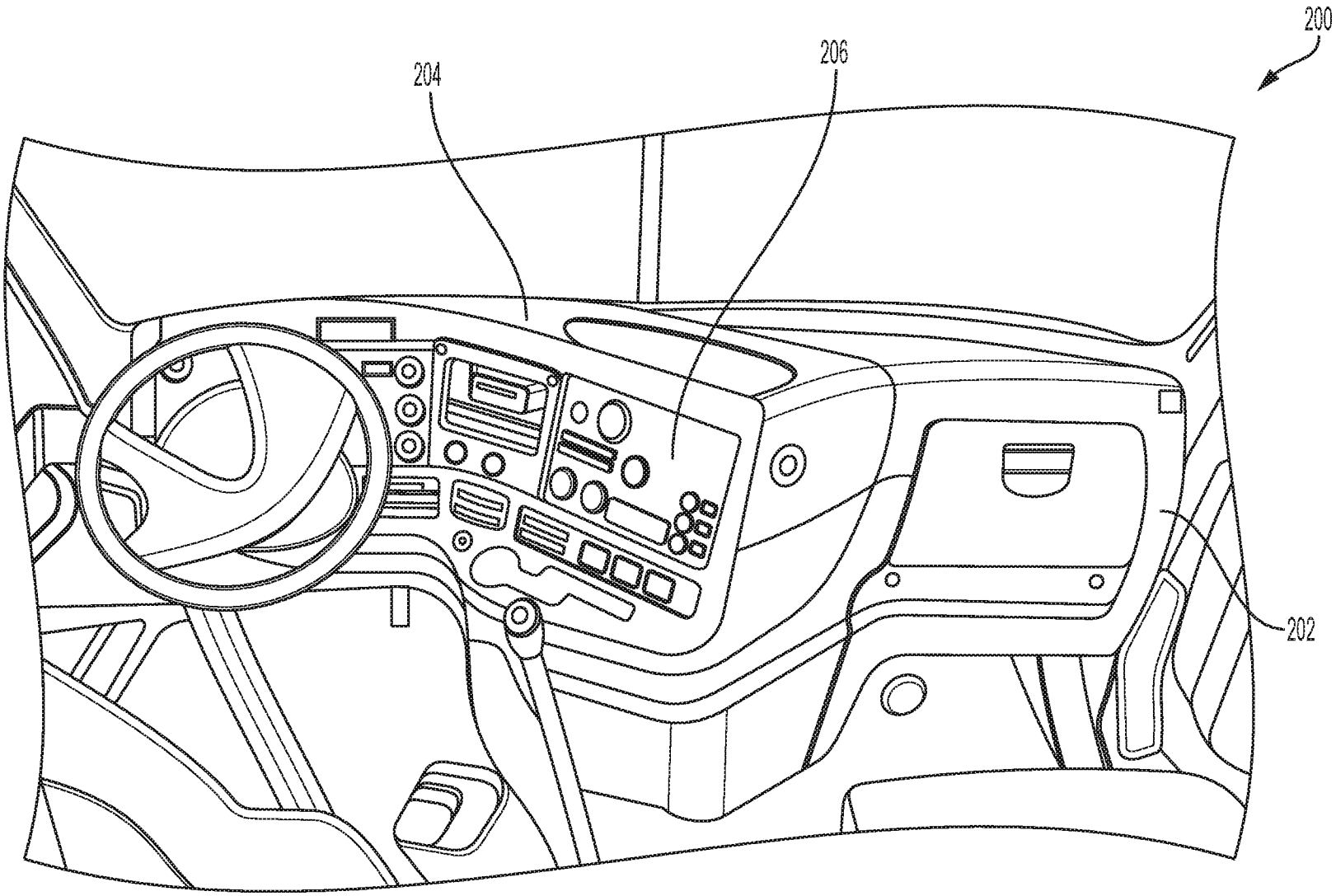
FIG. 5 is a view of a cab having a boom arm alarm assembly consistent with the technology of the present application.
Figure 6:
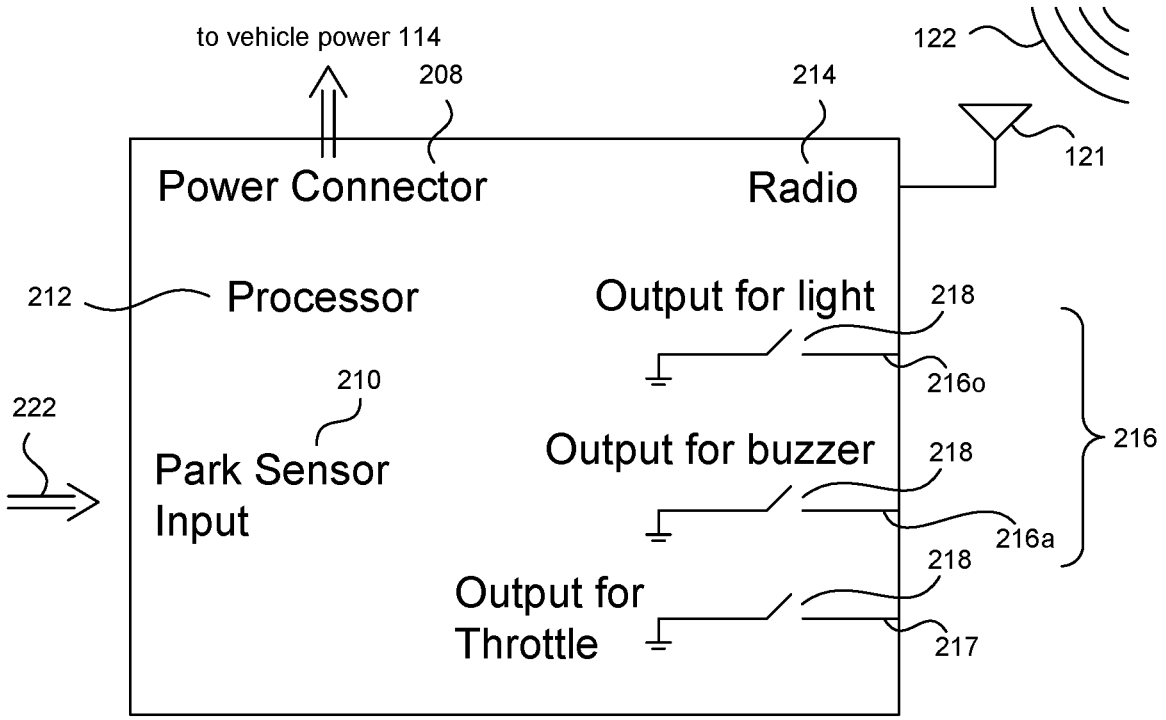
FIG. 6 is a diagram of a boom arm alarm assembly consistent with the technology of the present application.

FIG. 5 shows a view of an interior 200 of a cab 202 of a truck, which would be connectable to the feed trailer 100 above, as well as connectable to other feed trailers as to be explained further below. The cab 202 may have a dash 204 mounted boom arm alarm assembly 206. The boom arm alarm assembly 206 may be mounted separate from the dash 204 as a design choice. The boom arm alarm assembly 206, which is shown in more detail in FIG. 6, comprises a power port 208, which may receive vehicle power 114 similar to the power source for the sensor assembly 110, a park sensor input port 210, a processor 212, a receiver 214 (such as a radio, a transceiver, or a receiver) as well as one or more indicia outputs 216. As shown, the outputs 216 may include an audio signal 216*a* (a.k.a. a buzzer) or an optical signal 216*o* (a.k.a. a light) to alert the vehicle operator that the boom arm 102 is not in the saddle 106 prior to moving the vehicle, which functionality will be explained further below. In certain embodiments, the boom arm alarm assembly 206 may include a throttle output 217 that would inhibit engine operation during an alarm condition (a.k.a. a throttle kill output).

The receiver 214 receives the signal 122 from the sensor assembly transmitter 119. The processor 212 uses the signal 122 as an input. If the signal 122 is interpreted by the processor 212 as the boom arm 102 is stowed in the saddle 106, the processor 212 would cause one or more switches 218 to open such that the indicia outputs 216 remain off in this instance. While shown as switches, the processor 212 may simply not provide a power output to the indicia outputs 216, which would be equivalent to opening a switch. Other devices could be used as well. As neither the light or buzzer are on/sounding, the vehicle operator would know that the boom arm 102 is in the stowed position and/or that the feed trailer could not be moved.

As mentioned previously, the position of the boom arm 102 is only an issue if the boom arm 102 is NOT stowed and the vehicle, such as the feed trailer 100, is moved. Thus, the boom arm alarm assembly 206 also receives input from a park sensor 220, FIG. 7. The park sensor 220 provides a signal 222 to the processor 212 indicative of whether the parking brake associated with the feed trailer 100 is set. If the parking brake is set, the truck should be stationary and, therefore, the position of the boom arm 102 is not relevant. Thus, if the processor 212 receives a signal 222 indicating that the parking brake is set, the processor 212 would cause one or more switches 218 to open such that the indicia outputs 216 remain off in this instance. As neither the light or buzzer are on/sounding, the vehicle operator would know that the boom arm 102 is in the stowed position and/or that the feed trailer could not be moved.

Figure 7:
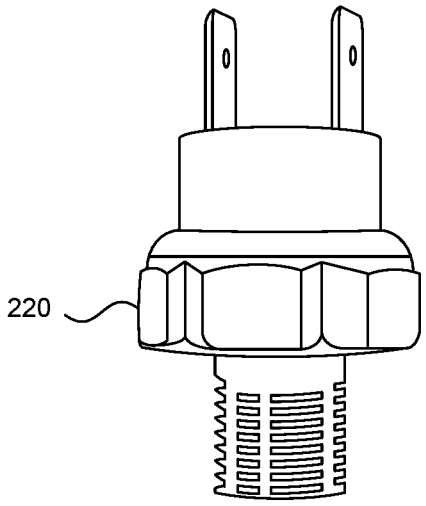
FIG. 7 is a pressure switch configured to provide input to the boom arm alarm assembly of FIG. 6.

Cabs 202 and feed trailer 100, including the prior art trucks described above, have parking brakes that operate from vehicle fluid pressurized systems, as is generally known in the art. The fluid pressurized brake system is pressurized when the parking brake is set. When set, the fluid pressurized brake system inhibits the truck from moving. The fluid pressurized brake system may use a gas, such as a pneumatic system, or liquid, such as a hydraulic system, as the fluid source. For simplicity, the fluid pressurized brake system may be referred to as the parking brake. FIG. 7 shows a parking brake set detector 220. The parking brake set detector 220, which may be a pressure gauge, a pressure switch (as shown), a differential pressure gauge, or the like, transmits a signal 222 to the processor 212 indicative of whether the parking brake is set. As shown, the parking brake set detector 220 is a pressure switch that trips on/off based on pressurization of the parking brake. Generally, to provide protection in case of a power failure or switch failure, the parking brake set detector 220, or switch in this case, is open when the parking brake is set (or pressurized), which transmits a low or zero signal to the processor 212. When the parking brake is released (or depressurized), the switch would close and transmit a high or one signal to the processor 212. When pressurized (or no/low signal), the processor 212 would open one or more switches 218 such that the one or more indicia remain off. As mentioned above, alternatively the processor 212 simply does not power the outputs to the indicia. Alternative to a pressurized line, the parking brake set detector 220 may determine the status of the parking brake by activation via a hand brake, a foot brake, or the like, which detector may be a mechanical movement detector or switch.

The boom arm alarm assembly 206 will not activate alarms when the parking brake is set. The boom arm alarm assembly 206 may, or may not, determine the position of the boom arm 102 when the parking brake is set because movement of the vehicle is unlikely or prevented. The release of the parking brake may cause the parking brake set detector 300 to transmit a signal, such as a voltage signal, to the processor 212. The processor 212 determines, based on the signal 222 from the parking brake set detector 220, that the parking brake is released. The processor 212 would next determine whether the boom arm 112 is in the one or more saddles 106. If the sensor assembly 110 determines the boom arm 112 is within the one or more saddles, the processor 212 disables the outputs to the indicia. If the processor 212 determines the boom arm 112 is NOT within the one or more saddles 106, the processor 212 would enable the outputs to the indicia by closing switches 218 and/or powering an audio and/or visual alarm output (buzzer and light). In some embodiments, an alarm condition may cause the processor 212 to provide switch 218 (or output) that powers a throttle kill signal 217 to prevent fuel to the engine combustion chamber (or for an electric vehicle, the battery would be disconnected from the drive system).

While the above operates effectively once the sensor assembly 110 and the boom arm alarm assembly 206 are wirelessly coupled, a person of ordinary skill in the art will recognize on reading the disclosure that a single cab 202 may couple to a plurality of trailers 100 and a single trailer 100 may couple to a plurality of cabs 202. Thus, the processor 212 in the boom arm alarm assembly 206 in the vehicle cab must be able to couple (a.k.a. bind) to the sensor assembly 110 of the trailer 100 to which it is hooked up to form a single truck. Typically, the cab 202 and the trailer 100 are connected to form a unit in a fleet yard. Thus, there are often several cabs and several trailers located in the fleet yard. Thus, several boom arm alarm assemblies 206 and several sensor assemblies 110 may be powered, transmitting, and within a transmit/receive range of the devices. Each boom arm alarm assembly 206 of a particular cab 202 must have a procedure to bind (operatively couple) to the sensor assembly 110 of the feed trailer 100 to which it is connected.

Wirelessly coupling a transmitter/receiver or transceiver on/in a cab with a transmitter/receiver or transceiver on/in a trailer may in certain circumstances be accomplished by determining what transmitters/receivers or transceivers are viewable (within a sensor range) after a predetermined amount of time while the truck (cab/trailer) is in motion. However, in this particular instance, motion of the truck must be inhibited to ensure the boom arm is in the saddle prior to allowing for motion. Thus, motion-based binding in the first instance is not an acceptable form of binding the wireless transmitter/receiver or transceiver combinations. Determining what sensor assembly from a plurality of sensor assemblies is still within the field of view after a predetermined amount of motion may be useful if the below procedures result in the cab processor binding to sensor assemblies on more than one trailer.

When connecting a cab and trailer, the cab is typically backed into the trailer hitch. The engine is killed (or turned off) while the cab and trailer are connected via the trailer hitch. Once the cab and trailer are coupled via the trailer hitch, the vehicle operator (truck driver) typically couples the trailer to the cab power system such that the cab engine powers (a.k.a. vehicle power) the trailer electrical systems. Thus, when the engine is turned on, the cab electronics and the trailer electronics are powered essentially at the same time. The processor 212 in/on the cab 202 will time stamp (and possibly date stamp) the power on time. The processor 117 in/on the trailer will similarly time stamp its power on time and broadcast the power on time along with other initial data via its transmitter 119 that is received by the receiver 214 associated with processor 212. The processor 212 would compare its power on time to the power on time of signal received from the processor 117. If the power on time of the two devices with a predetermined time range, such as within ±several seconds, the processor 212 would bind to processor 117 as the sensor assembly of the connected trailer. The predetermined time range may be if the trailer processor powers on within ±200 millisecond of the cab processor (e.g., the trailer processor powers on shortly before or shortly after the cab processor powers on). The predetermined time range may be lengthened or shortened depending on whether the internal clocks of the processor 212 and the processor 117 are sufficiently in sync. If the internal clocks are not sufficiently in sync, the predetermined time range may be much higher than a few milliseconds, such as, for example, 10 total seconds or less of clock signal. A high predetermined time range is possible as it is unlikely multiple cabs and trailers are turned on within several seconds of each other. Of course, the binding may cascade several predetermined timing ranges. For example, the cab processor may first determine whether any cab processors powered on within ±180 milliseconds or less. If no matches are found, the cab processor may next determine whether any cab processors powered on within ±0.5 seconds or less. If no matches are found, the cab processor may next determine whether any cab processors powered on within ±1.0 second, which could be followed by a 2 second window, a 4 second window, a 7 second window, a 10 second window etc. A failure mode may register if no processors 117 are found within the one or more search windows. Alternatively, not binding to a sensor assembly may indicate that the cab is not connected to a trailer.

While it is unusual for multiple processors 117 to be powered on within the predetermined range of time of any particular processor 212 being powered on, when it happens the event is not problematic. When this occurs, the processor 212 will initially bind to multiple processors 117 within a receiving/transmitting range that powered on within the same time period. In the event this occurs, the processor 212 will alarm when the parking brake is released and if any of the bound processors 117 transmits a signal that the boom arm is out of the saddle. Notice, the processor 212 may remember a previously bound processor 117 if the processor 117 causes the transmission of a unique ID, such as a device serial number or the like. If multiple processors 117 are detected within a binding window, but one processor 117 was previously bound to the processor 212, the processor 212 will bind to the recognized processor 117, in other words the processor 117 that was viewed within the predetermined range of time (window) and has a recognized or remembered ID. If several processors 117 are bound to the processor 212, the system may drop (unbind) sensors that do not remain within the field of view for a predetermined time after motion of the vehicle is detected. For example, processor 212 may bind to three (3) processors 117. After 15 seconds of travel, only two (2) processors 117 remain in the field of view of processor 212, which would cause processor 212 to unbind the dropped processor 117. After 30 seconds of travel, only one (1) processor 117 may remain in the field of view and processor 212 would unbind the processor 117 that left the field of view.

Once the binding between the processor 117 and processor 212 occurs, the processors will remain bound until the processor 212 no longer views processor 117 (e.g., the processor 212 is outside the transmission range of processor 117 or the like). The processor 212 may only drop a processor outside of its view after a predetermined safety time, such as several seconds, to avoid inadvertent power glitches from improperly unbinding the processors. A predetermined safety time may be, for example, 10 seconds, 20 seconds, 52 seconds or the like.

In some circumstances, the boom arm alarm assembly 206 in the cab 202 will have power but not be bound to any sensor assemblies 110. In this case, the boom arm alarm assembly 206 may bind to any sensor assemblies 110 that present to its field of view, whether by newly turning on and/or newly entering the field of view by some other means, such as, for example, the tractor pulling up to a trailer and providing power to the trailer. As can be appreciated, field of view means the transmission from the sensor assembly 110 is receivable by the boom arm alarm assembly 206.

The boom arm alarm assembly 206 may have one or more outputs (or a graphical user interface) that provides different information depending on the configuration and binding with sensor assembly 110. Generally, the boom arm alarm assembly 206 will provide general information but no alarm or warning information unless the parking brake is release and a boom arm is determined to NOT be stowed, which would provide an alarm—whether audio, visual, or both (and in certain cases, a kill signal would be sent). However, other conditions may provide useful information. For example, indicia may indicate a parking brake is set or released. In another example, indicia may indicate whether a sensor assembly 110 is bound. In yet another example, indicia may indicate whether a bound sensor assembly 110 indicates a boom arm is not stowed.

Figure 8:
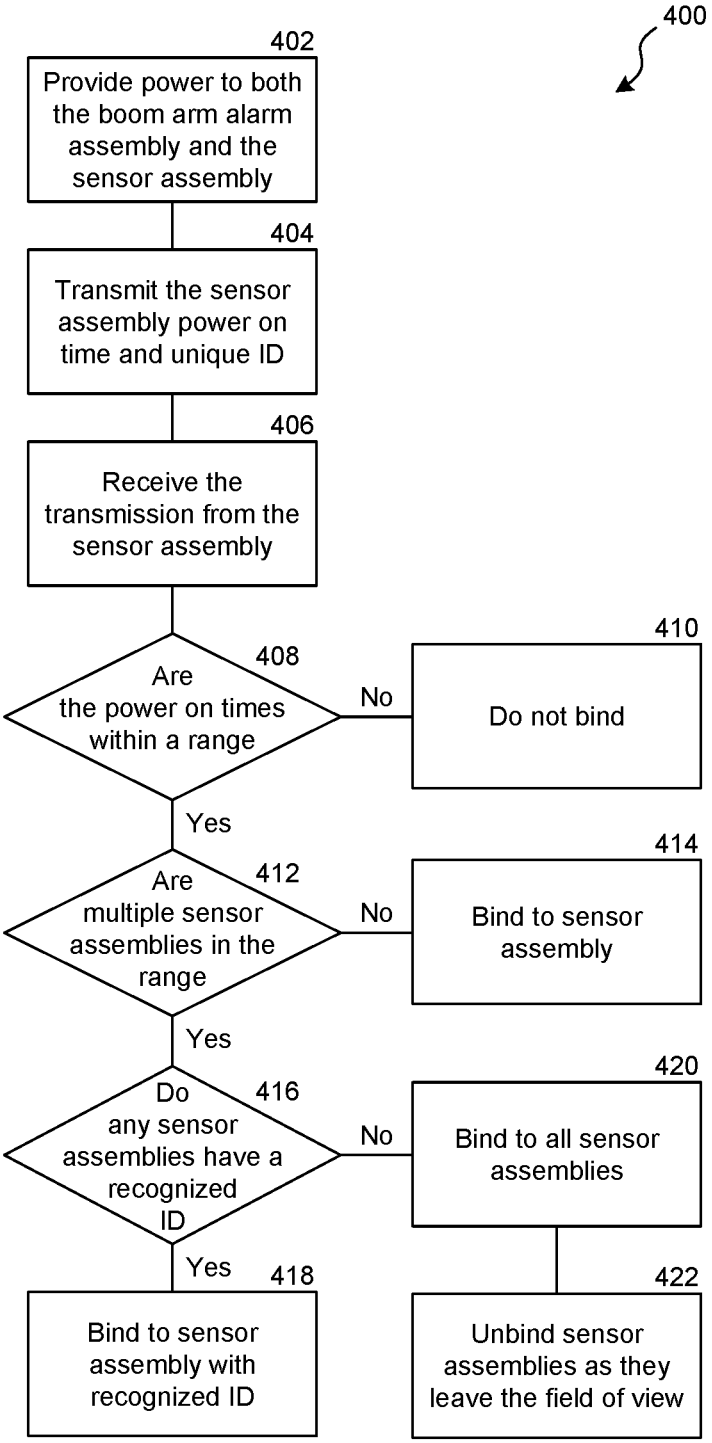
FIG. 8 is a flow chart of a binding operation consistent with the technology of the present application.

With reference now to FIG. 8, a flowchart 400 for binding concurrently powered sensor assemblies and boom arm alarm assemblies is provided. While shown as an order of discrete steps, the steps shown in flowchart 400 may be performed as shown, substantially simultaneously, or in different order. Moreover, some of the steps in the flowchart 400 may be combined into a single operation and/or single steps in the flowchart 400 may be broken into multiple operations.

First, at step 402, power is provided to both the boom arm alarm assembly and the sensor assembly as well as their components. The sensor assembly transmits its power on time and, optionally, its unique ID at step 404. The boom arm alarm assembly receives the transmission from the sensor assembly at step 406. The boom arm alarm assembly next determines whether the power on times are within the predetermined time range, step 408. If the power on times are not within the predetermined time range, the sensor assembly is not bound, step 410. If the power on times are within the predetermined time range, it is next determined if multiple sensor assemblies are available for binding, step 412. If multiple sensor assemblies are not available (in other words only one (1) sensor assembly powered on within the predetermined time range), the sensor assembly is bound to the boom arm alarm assembly, step 414. If multiple sensor assemblies are available for binding, it is next determined if one of the multiple sensor assemblies available has a recognized unique ID, step 416. If a unique ID is recognized, than that sensor assembly is bound to the boom arm alarm assembly, step 418. If none of the sensor assemblies have a recognized unique ID, then all the available sensor assemblies are bound to the boom arm alarm assembly, step 420. If multiple sensor assemblies are bound, some of the multiple sensor assemblies may be unbound as they leave the field of view, step 422.

Figure 9:
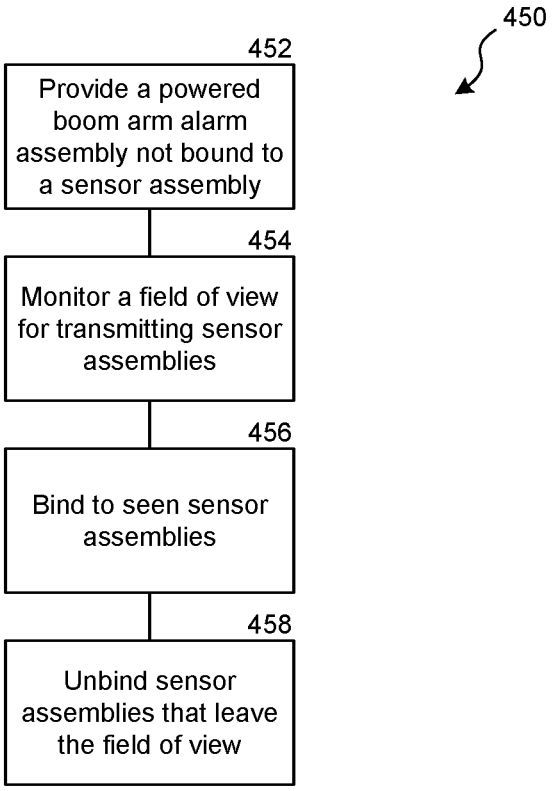
FIG. 9 is a flow chart of a binding operation consistent with the technology of the present application.

With reference now to FIG. 9, a flowchart 450 for binding a boom arm alarm assembly and a sensor assembly when the devices are not powered at substantially the same time. While shown as an order of discrete steps, the steps shown in flowchart 450 may be performed as shown, substantially simultaneously, or in different order. Moreover, some of the steps in the flowchart 450 may be combined into a single operation and/or single steps in the flowchart 450 may be broken into multiple operations.

First, at step 452, a powered boom arm alarm assembly that is NOT bound to a sensor assembly is provided. The boom arm alarm assembly monitors its field of view of transmitting sensor assemblies, step 454. The boom arm alarm assembly binds to any transmitting sensor assemblies in its field of view, step 456. The boom arm alarm assembly unbinds transmitting sensor assemblies as they leave the field of view, step 458. Notice, the powered boom arm alarm assembly process may be especially useful if triggered by an event signaling eminent motion of the vehicle. For example, an optional step between the monitoring the field of view (step 454) and binding (step 456) may be detect a brake release, which signals the vehicle is about to move. At this time, the boom arm alarm assembly may bind to any sensor assemblies in its field of view once the brake is released.

As can be appreciated with both binding operations, as well as other operations within the spirit and scope of the application, multiple sensor assemblies may be bound to a boom arm alarm assembly. Any one sensor assembly may inhibit vehicle motion if a throttle kill is enabled on the boom arm alarm assembly. Thus, an override may be provided to allow vehicle operation once it is confirmed that the boom arm is properly stowed.

Although the technology has been described in language that is specific to certain structures and materials, it is to be understood that the invention defined in the appended claims is not necessarily limited to the specific structures and materials described. Rather, the specific aspects are described as forms of implementing the claimed invention. Because many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A sensor assembly for a vehicle comprising a cab and a trailer wherein the sensor assembly is operatively coupled to the trailer having a boom arm and configured to detect whether the boom arm is positioned in a saddle on the trailer; the sensor assembly comprising:

a housing;

a processor within the housing;

a transmitter within the housing coupled to the processor;

an antenna operatively coupled to the transmitter and the housing;

a proximity sensor operatively coupled to the processor wherein the proximity sensor is operatively coupled to the saddle on the trailer, wherein the proximity sensor sends a signal to the processor indicative of whether the boom arm is positioned in the saddle and the processor causes the transmitter to transmit a signal using the antenna to a boom arm alarm assembly in a cab and wherein a receiver operatively coupled to the boom arm alarm assembly is configured to provide an alarm if the boom arm is not positioned in the saddle.

2. The sensor assembly of claim 1 wherein the proximity sensor comprises a magnetic sensor.

3. The sensor assembly of claim 2 wherein the magnetic sensor detects that the boom arm is positioned within the saddle when the boom arm is within 30 millimeters of the magnetic sensor.

4. The sensor assembly of claim 2 wherein the magnetic sensor detects that the boom arm is positioned within the saddle when the boom arm is within 18 millimeters of the magnetic sensor.

5. The sensor assembly of claim 1 wherein the proximity sensor is a pressure sensor.

6. The sensor assembly of claim 5 wherein the pressure sensor is a mechanical switch.

7. The sensor assembly of claim 1 comprising a power source.

8. The sensor assembly of claim 1 wherein the power source comprises a port operatively coupled to the housing coupling the processor with a vehicle power source.

9. The sensor assembly of claim 1 wherein the boom arm alarm assembly is configured to provide the alarm when the boom arm is not positioned in the saddle and the trailer parking brake is not engaged.

10. An apparatus, comprising:

a vehicle comprising:

a vehicle cab;

a vehicle trailer coupled to the vehicle cab;

a boom arm pivotally coupled to the vehicle trailer; and a saddle coupled to the vehicle trailer, wherein the boom arm has a deployed position and a retracted position such that when in the retracted position, the boom arm is contained within the saddle on the vehicle trailer;

a boom arm sensor assembly operatively coupled to the vehicle trailer, the boom arm sensor assembly comprising a proximity sensor to detect whether the boom arm is contained within the saddle and transmit a signal indicating that the boom arm is contained within the saddle; and a boom arm alarm assembly operatively coupled to the vehicle cab, the boom arm alarm assembly configured to receive the signal transmitted from the boom arm sensor assembly and provide an alarm when the boom arm is not detected within the saddle.

11. The apparatus of claim 10 wherein the boom arm alarm assembly is operatively coupled to a throttle of the vehicle cab such that the boom arm alarm assembly inhibits engine operation during an alarm condition.

12. The apparatus of claim 10 wherein the alarm is optical.

13. The apparatus of claim 10 wherein the alarm is at least audible.

14. The apparatus of claim 10 comprising a parking brake set detector.

15. The apparatus of claim 14 wherein the boom arm alarm assembly receives a signal indicative of whether a vehicle cab parking brake is set from the parking brake set detector and wherein the boom arm alarm assembly disables the alarm when the signal is indicative of the vehicle cab parking brake being set.

16. The apparatus of claim 15 wherein the parking brake set detector is a fluid pressure sensor.

17. The apparatus of claim 10 further comprising an alarm override.

18. A boom arm sensor and alarm system comprising:

a boom arm sensor assembly configured to be coupled to a trailer, wherein the trailer comprises a saddle for receiving a boom arm, the boom arm sensor assembly comprising:

a proximity sensor operatively coupled to the trailer wherein the proximity sensor detects whether the boom arm is positioned within the saddle or whether the boom arm is not positioned within the saddle;

a sensor processor operatively coupled to the proximity sensor; and a transmitter operatively coupled to the processor and configured to transmit a signal indicative of whether the boom arm is positioned in the saddle;

a boom arm alarm assembly configured to be coupled to a cab comprising:

a receiver configured to receive the signal indicative of whether the boom arm is positioned in the saddle from the transmitter;

an alarm processor operatively coupled to the receiver; and an alarm operatively coupled to the alarm processor wherein the alarm processor causes the alarm to sound when the alarm processor determines the signal received from the transmitter indicates the boom arm is not positioned in the saddle.

19. The boom arm sensor and alarm system of claim 18 wherein the boom arm sensor assembly is powered by a connection to a trailer power system and the boom arm alarm assembly is powered by a connection to the cab power system.

20. The boom arm sensor and alarm system of claim 18 comprising a parking brake set detector wherein the boom arm alarm assembly is configured to receive a signal from the parking brake set detector indicative of the status of the cab parking brake.

21. The boom arm sensor and alarm system of claim 18 wherein the alarm processor causes the alarm to sound by at least one a visual alarm and an audio alarm.

* * * * *